US008469476B2

(12) United States Patent
Mandel et al.

(10) Patent No.: US 8,469,476 B2
(45) Date of Patent: Jun. 25, 2013

(54) SUBSTRATE MEDIA REGISTRATION SYSTEM AND METHOD IN A PRINTING SYSTEM

(75) Inventors: Barry P. Mandel, Fairport, NY (US); Joannes N. M. de Jong, Hopewell Junction, NY (US); Injae Choi, Webster, NY (US); Marina Tharayil, Rochester, NY (US); Dusan G. Lysy, Fairport, NY (US); Lloyd A. Williams, Mahopac, NY (US)

(73) Assignee: Xerox Corporation, Norwalk, CT (US)

( * ) Notice: Subject to any disclaimer, the term of this patent is extended or adjusted under 35 U.S.C. 154(b) by 302 days.

(21) Appl. No.: 12/911,129

(22) Filed: Oct. 25, 2010

(65) Prior Publication Data

US 2012/0098879 A1 Apr. 26, 2012

(51) Int. Cl.
*B41J 29/38* (2006.01)
*B41J 2/01* (2006.01)

(52) U.S. Cl.
USPC ..... 347/16; 347/14; 347/101

(58) Field of Classification Search
USPC ..... 347/16, 14, 19, 101, 104
See application file for complete search history.

(56) References Cited

U.S. PATENT DOCUMENTS

| | | | | |
|---|---|---|---|---|
| 5,678,159 | A | 10/1997 | Williams et al. | |
| 7,645,013 | B2 | 1/2010 | Murakami et al. | |
| 2002/0145249 | A1 * | 10/2002 | Acquaviva et al. | 271/228 |
| 2004/0141782 | A1 | 7/2004 | Kato | |
| 2006/0163801 | A1 | 7/2006 | DeJong et al. | |
| 2006/0238561 | A1 * | 10/2006 | Carcia et al. | 347/30 |
| 2007/0091132 | A1 * | 4/2007 | Lim | 347/14 |
| 2007/0236754 | A1 | 10/2007 | Tashiro et al. | |
| 2007/0285461 | A1 * | 12/2007 | Okada | 347/33 |
| 2009/0121419 | A1 * | 5/2009 | deJong et al. | 271/228 |

* cited by examiner

*Primary Examiner* — Jason Uhlenhake

(57) ABSTRACT

Embodiments described herein include a substrate media registration system in a printing system. The registration system can include a deskewing system, a reflexive system, and a controller. The deskewing system is configured to deskew substrate media. The reflexive system is configured to detect the lateral position of the substrate media and at least one of a lead edge and a trail edge of the substrate media being transported in the process direction. The controller is operatively coupled to the reflexive system and is configured to control ejection of ink from a print head system in response to detecting the lateral position of the substrate media and at least one of the lead edge and the trail edge of the substrate media.

20 Claims, 6 Drawing Sheets

SUBSTRATE MEDIA REGISTRATION SYSTEM AND METHOD IN A PRINTING SYSTEM

BACKGROUND

1. Technical Field

The presently disclosed embodiments are directed to a substrate media registration system in a printing system.

2. Brief Discussion of Related Art

Typically, higher end xerographic and direct marking media registration systems register paper in three degrees of freedom: process direction; cross process direction; and skew. Since these registration systems typically perform registration with respect to the three degrees of freedom, the registration systems are relatively inefficient, complex, costly, and speed limited. In these systems, the paper is typically shifted with respect to these degrees of freedom to align the paper with the image to be disposed on the paper.

In some Xerographic systems, the average position of the media in the lateral direction is measured in manufacturing and then the location of the image that is written onto the photoreceptor is adjusted based on this average measurement. These systems help reduce the lateral image to paper registration error however they do not correct lateral errors on an individual sheet by sheet basis. Systems have been proposed in which media is tacked onto a relatively long escort belt without deskewing the paper so that the skewed paper does not move with respect to the belt. In these printing systems, the paper is registered by measuring the position of the paper on the escort belt and the image to be disposed on the paper is warped to match the media position. This process would add significant complexity to the media transport and warping the image to conform to the media position could result in image artifacts, especially when correcting for large skew.

SUMMARY

According to aspects illustrated herein, there is provided a direct marking printing system configured for substrate registration without warping an image. The system includes a print head having print nozzles, a media transport unit, a deskewing system, a reflexive system, and a controller. The media transport unit transports substrate media passed the print head. The deskewing system has at least one roller to deskew the substrate media. The reflexive system has one or more sensors to detect a lateral position of the substrate media on the media transport belt and at least one of a lead edge and a trail edge of the substrate media as the substrate media is being transported in the process direction by the media transport unit. The controller is operatively coupled to the print head and the reflexive system. The controller selects a subset of print nozzles from which ink is to be ejected based on the lateral position of the substrate media on the media transport belt and determines when the ink is to be ejected from the subset of print nozzles in response to detection of at least one of the leading edge and the trailing edge by the edge sensor.

According to other aspects illustrated herein, there is provided a substrate media registration system in a printing system that includes a deskewing system, a reflexive system, and a controller. The deskewing system is configured to deskew substrate media. The reflexive system is configured to detect a lateral position of the substrate media and at least one of a lead edge and a trail edge of the substrate media being transported in the process direction. The controller is operatively coupled to the reflexive system and is configured to control ejection of ink from a print head of the reflexive system in response to detecting the lateral position of the substrate and at least one of the lead edge and the trail edge of the substrate media.

According to further aspects illustrated herein, there is provided a method of registering substrate media in a printing system. The method includes deskewing the substrate media using at least one deskewing roller to align a lead edge of the substrate media to be substantially parallel to a cross-process direction and transferring the substrate media to a media transport unit. A position of the substrate media being fixed with respect to the media transport unit. The method also includes detecting a lateral position of the substrate media on the media transport unit, detecting the process direction position of the substrate media on the media transport unit, configuring a print head to compensate for the lateral position of the substrate media on the media transport unit, and ejecting ink from the print head in response to detecting the process direction position of the substrate media.

DETAILED DESCRIPTION

Figure 1:
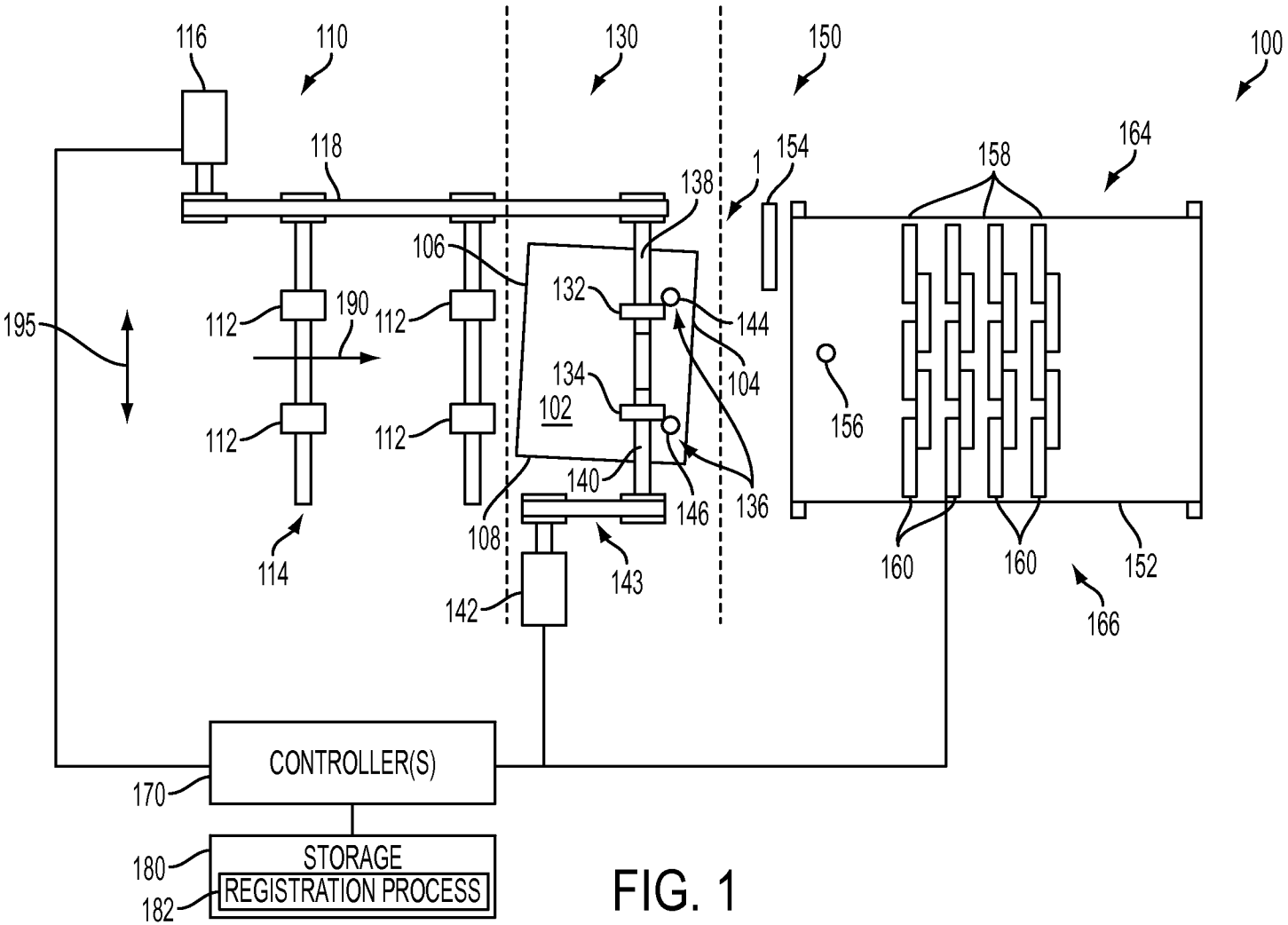
FIGS. 1 and 2 show an exemplary printing system in which a substrate media registration process can be implemented.

Exemplary embodiments are directed to a substrate media registration system for printing systems, such as direct marking printing systems. Embodiments of the registration system can be configured to perform a substrate media registration process in which substrate media is deskewed, but is not shifted to correct for process and/or cross-process registration errors. Process and cross-process registration can be performed at a printing station using one or more print heads without warping the image and without adjusting the position of the substrate media. In this manner, the registration system can provide an efficient, effective, and simplified registration process for achieving high-quality print images on substrate media.

Embodiments of the registration system can be used with single pass systems, multi-pass systems, simplex path systems, duplex path systems, and the like. Embodiments of the registration system can simplify and/or reduce the cost of substrate media handling systems for achieving image-on-paper registration. For embodiments implemented in single pass systems, the registration system can facilitate high speed operation since a lateral carriage reset can be avoided and minimal drive forces can be used.

As used herein, "substrate media" refers to a tangible medium, such as paper (e.g., a sheet of paper, a long web of paper, a ream of paper, etc.), transparencies, parchment, film, fabric, plastic, or other substrates on which an image can be printed or disposed.

As used herein, "ink" and "toner" refer to matter used to form images on a belt and/or substrate media. While ink is generally stored in a liquid form and toner is generally stored in a solid form, ink and/or toner can be stored in various forms. For example, ink can be stored in a liquid form or a solid form. The term ink is used generally herein to mean either ink or toner.

As used herein, a "printing system" refers to a device, machine, apparatus, and the like, for forming images on substrate media using ink, toner, and the like, and a "multi-color printing system" refers to a printing system that uses more than one color (e.g., red, blue, green, black, cyan, magenta, yellow, clear, etc.) ink or toner to form an image on substrate media. A "printing system" can encompass any apparatus, such as a printer, digital copier, bookmaking machine, facsimile machine, multi-function machine, etc. which performs a print outputting function. Some examples of printing systems include Direct-to-Paper (e.g., Direct Marking), modular overprint press (MOP), ink jet, solid ink, as well as other printing systems.

As used herein, a "direct marking printing system" or "direct-to-paper printing system", refers to a printing system in which ink is disposed directly to substrate media as opposed to building an image on an intermediate transfer belt or drum and subsequently transferring the image to the substrate media.

As used herein, a "print head" refers to a device that disposes, transfers, forms, or otherwise generates an image on a substrate media and "print nozzles" refer to apertures or openings on a print head from which ink is ejected to dispose, transfer, form, or otherwise generate an image on a substrate media.

As used herein, an "image" refers to a visual representation, reproduction, or replica of something, such as a visual representation, reproduction, or replica of the contents of a computer file rendered visually by a printing system. An image can include, but is not limited to: text; graphics; photographs; patterns; pictures; combinations of text, graphics, photographs, and patterns; and the like.

As used herein, "warping" refers to distorting an image to be disposed on substrate media from its original or true dimensions or orientation.

As used herein, a "media transport unit" refers to an apparatus that transports substrate media passed a print station in a printing system. Some examples of media transport units include a media transport belt and a rotating media drum.

As used herein, "sensor" refers to a device that responds to a physical stimulus and transmits a resulting impulse for the measurement and/or operation of controls. Such sensors include those that use pressure, light, motion, heat, sound and magnetism. Also, each of such sensors as referred to herein can include one or more point sensors and/or array sensors for detecting and/or measuring characteristics or parameters in a printing system, such as substrate media location, position, speed, orientation, process or cross-process position, and the like.

As used herein, "detecting" refers to identifying, discovering, or recognizing the presence or lack thereof of an object or thing, such as the presence of substrate media.

As used herein, a "roller" refers to a nip or cam that guides and/or transports substrate media in the process direction through a printing system.

As used herein, "skewed" refers to a position of an object or thing with respect to a reference line or surface where the object or thing is neither perpendicular nor parallel to the reference line or surface. For example, substrate media can be skewed when a leading edge of substrate media is not substantially parallel to a cross-process direction.

As used herein, "deskewing" refers to a process of removing skew.

As used herein, "substrate media registration" refers to compensating for positional errors of substrate media with respect to at least one of skew, a cross-process direction, and a process direction.

As used herein, a "substrate media registration system" refers to a system that performs substrate media registration.

As used herein, a "deskewing system" refers to a system for deskewing skewed substrate media.

As used herein, a "reflexive system" is a system that reacts based on detected stimuli to facilitate compensation and/or correction of registration errors in a printing system.

As used herein, "process direction" refers to a direction in which substrate media is processed through a printing device and "cross-process direction" or "lateral" refers to a direction substantially perpendicular to the process direction.

As used herein, "lateral position" refers to a position of an object or thing in the cross-process direction.

As used herein, "downstream" refers to location of an object relative to a location of another object based on the process direction, wherein an object is downstream from another object when it is located away from the other object in the process direction.

As used herein, "upstream" refers to location of an object relative to a location of another object based on the process direction, wherein an object is upstream from another object when it is located away from the other object in a direction that is opposite to the process direction.

As used herein, a "lead edge" refers to an edge of the substrate media that is further downstream than the remainder of the substrate media.

As used herein, "inboard" and "outboard" are used and arbitrarily assigned to refer to lateral sides (e.g., media sides that are perpendicular to the lead edge and/or trail edge) of the printing system.

As used herein, "transporting" refers to carrying and/or moving an object or thing, such as an image or substrate media, from location to another location.

As used herein, "align" refers to adjusting to a desired, intended, expected, or specified position.

As used herein, "position" refers to a location of one object or thing with respect to another object or thing, such as for example, a location of substrate media with respect to a print head and/or with respect to an inboard or outboard side of a media transport unit.

As used herein, "fixed" refers to constrained, set in place, not readily moveable, and the like.

As used herein, "configuring" refers to specifying, adjusting, or programming a device to perform an operation.

As used herein, "compensate" refers to offsetting, adjusting, or correcting the registration errors.

As used herein "ejecting" refers to disbursing, disposing, or expelling.

As used herein, a "controller" refers to a processing device for executing commands or instructions for controlling one or more components of a printing system and/or performing one or more processes implemented by the printing system.

Figure 2:
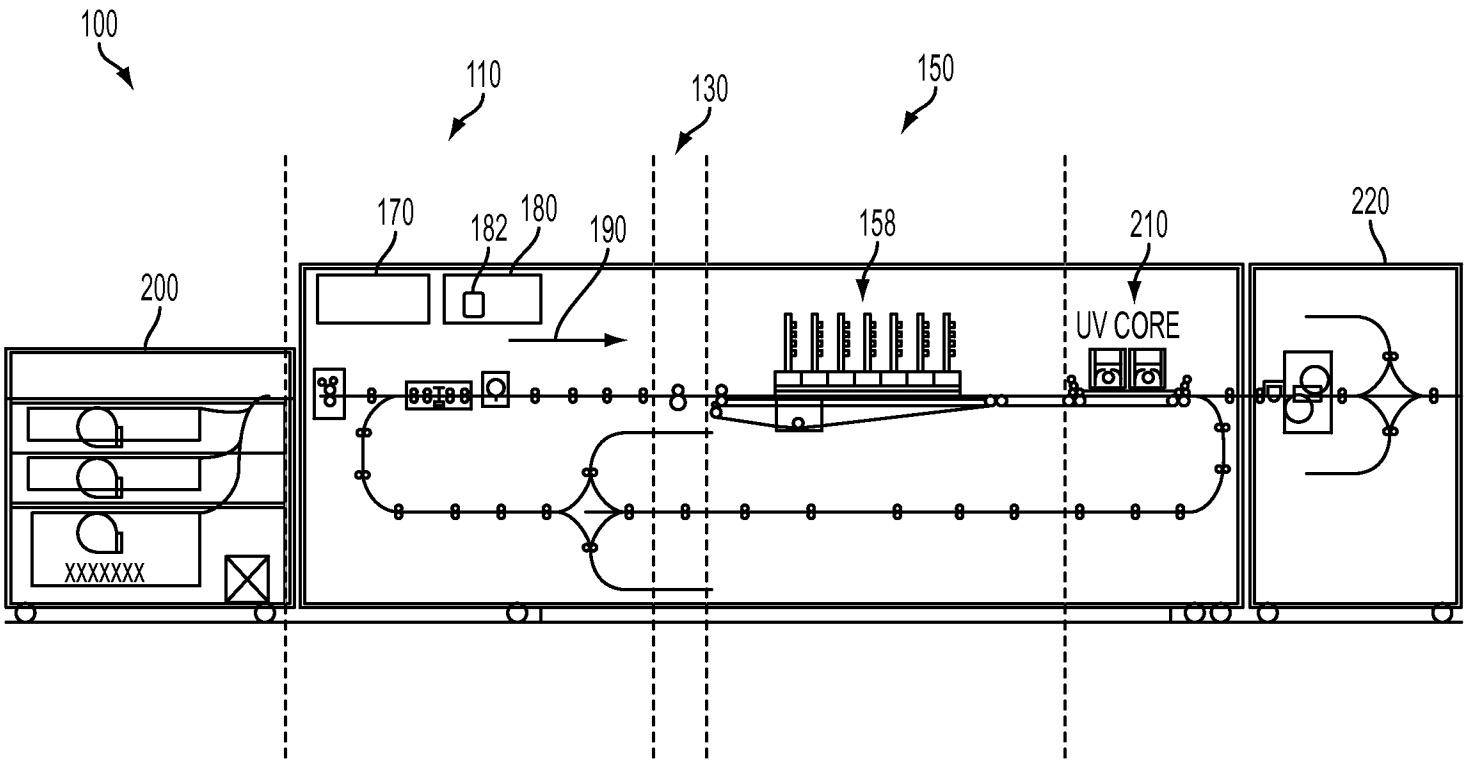

FIGS. 1 and 2 depict an image-to-paper or direct-to-paper printing system 100 (hereinafter printing system 100). The printing system 100 can include a transport region 110, a deskewing region 130, an image transfer region 150, one or more controllers 170, storage 180, a substrate media compartment 200 (FIG. 2), a curing unit 210 (FIG. 2), and an output unit 220 (FIG. 2). While components and operations of the printing system are described with relation to regions, those skilled in the art will recognize that the regions may or may not define physical regions in the printing system. The printing system can be implemented with a registration system formed from components of the printing system 100, which can be distributed in one or more of the regions of the printing system 100. The registration system can be configured to deskew substrate media, adjust the printing process based on a lateral position of the substrate media, and synchronize ink disbursement with the arrival of the substrate media.

The transport region 110 can transport substrate media 102 from the substrate media feeder 200 (FIG. 2) to the deskewing region 130, where the substrate media feeder 200 stores and feeds substrate media. The transport region 110 can include pre-registration transport nips 112 (hereinafter "transport nips 112") to facilitate the transport of the substrate media 102 in the process direction indicated by arrow 190. The transport nips 112 can be supported about drive shafts 114, which can be rotatively driven by a drive motor 116. Each drive shaft 114 can extend longitudinally in a lateral or cross process direction as indicated by arrow 195 in FIG. 1 and can support one or more of the transport nips 112. The drive motor 116 can be configured to drive the transport nips 112 at a constant velocity based on a velocity profile using, for example, a drive belt 118 operatively coupled to the drive shafts 114. The transport nips 112 can engage substrate media 102 entering the transport region 110 from the substrate media feeder 200 to drive substrate media 102 through the transport region 110 and towards the deskewing region 130.

The deskewing region 130 can receive the substrate media 102 received from the transport region 110 and the substrate media 102 can be deskewed in the deskewing region 130. For example, the substrate media 102 can be deskewed in the deskewing region 130 so that a leading edge 104 and/or trailing edge 106 of the substrate media 102 is shifted to be substantially perpendicular to the process direction (e.g., parallel to the cross process direction) and the side edges 108 (e.g., the inboard and outboard edges) of the substrate media 102 are substantially parallel to the process direction (e.g., perpendicular to the cross process direction). In some embodiments, the substrate media 102 is deskewed to within a predetermined tolerance. The deskewing region 130 can include deskewing roller 132, deskewing roller 134, and deskewing sensors 136. In some embodiments, the deskewing rollers 132 and 134 can adjust the skew of the substrate media 102 by aligning the substrate media 102 before the substrate media 102 enters the image transfer region 150. The deskewing rollers 132 and 134 can align the substrate media in response to an output of one or more of the deskewing sensors 136.

The deskewing roller 132 can be supported about a shaft 138, which can be operatively coupled to the drive motor 116 via the drive belt 118 so that the deskewing roller 132 rotates at a constant velocity in accordance with a velocity profile. The drive shaft 138 can extend longitudinally in the cross process direction. In some embodiments, the deskewing roller 132 can be configured to rotate at substantially identical velocity as the transport nips 112. While the present embodiment includes one deskewing roller disposed on the drive shaft 138, those skilled in the art will recognize that additional deskewing rollers can be supported by the drive shaft 138. Furthermore, those skilled in the art will recognize that the deskewing roller 132 can be driven by a different drive motor than the drive motor 116. For example, in some embodiments, the deskewing roller 132 can be driven by its own drive motor.

The deskewing roller 134 can be supported about a shaft 140 extending longitudinally in the cross process direction. In some embodiments, the drive shaft 140 can be operatively coupled to a variable speed drive motor 142 (hereinafter "drive motor 142") via a drive belt 143. The drive motor 142 can be configured to rotate the deskewing roller 134 at variable velocities to correct for detected substrate media skew. In some instances, the drive motor 142 can be configured to drive the deskewing roller 134 at a nominal default velocity, which can be substantially identical to the velocity at which the deskewing roller 132 is driven. In some instances, the drive motor 142 can be configured to drive the deskewing roller 134 at velocities greater than and/or less than the nominal default velocity, such as when deskewing the substrate media 102.

In some embodiments, a position of the roller 134 can be adjusted to move the roller towards and/or away from the substrate media to change the pressure with which the roller 134 engages the substrate media and the speed at which the roller 134 rotates. Using this approach, deskewing can be achieved with or without the variable drive motor. The pressure with which the roller 134 engages the substrate media can be based on the skew of the substrate media to be corrected.

While the present embodiment includes one deskewing roller supported about the drive shaft 140, those skilled in the art will recognize that additional deskewing rollers can be supported by the drive shaft 140. Furthermore, those skilled in the art will recognize that the deskewing rollers 132 and 134 can both be controlled by variable velocity drive motors. In addition, while the present example illustrates rollers 132 and 134 supported by shafts 138 and 140, respectively, those skilled in the art will recognize that additional deskewing rollers can be supported by additional shafts and that the additional rollers can be driven by drive motor 116, drive motor 142, or by different drive motors.

The deskewing sensors 136, which in the present embodiment include deskewing sensors 144 and 146, can sense the presence of the substrate media 102 as the substrate media 102 moves through the deskewing region 130. In the present embodiment, the deskewing sensors 136 are disposed downstream from the deskewing rollers 132 and 134 and are arranged in a linear manner in the cross process direction. The deskewing sensors 136 can detect the leading edge 104 of the substrate media 102 as the leading edge 104 passes the deskewing sensors 136. While the deskewing sensors 136 are downstream of the deskewing rollers 132 and 134 in the present example, those skilled in the art will recognize that the deskewing sensors 136 can be positioned upstream of the deskewing rollers 132 and 134. Furthermore, those skilled in the art will recognize that deskewing sensors 136 can detect the leading edge 104, trailing edge 106, inboard edge, and/or outboard edge of the substrate media 102 when detecting the substrate media 102 skew.

If each of the deskewing sensors 144 and 146 detect the leading edge 104 of the substrate media 102 at substantially the same time and/or within a predetermined time period, the controller(s) 170 of the printing system 100 can determine that the substrate media 102 is not skewed and the deskewing rollers 132 and 134 are driven at a substantially identical velocity so that no realignment of the substrate media 102 occurs (i.e., the substrate media is not deskewed).

If one of the deskewing sensors 136 detects the leading edge 104 of the substrate media 102 after one of the other deskewing sensors 136 and/or beyond the predetermined time period, the controller(s) 170 of the printing system 100 can determine that the substrate media 102 is skewed. In response to a determination that the substrate media is skewed, the controller(s) 170 of the printing system 100 can deskew the substrate media 102 by changing the velocity of the deskewing roller 134. In some embodiments, the velocity at which the deskewing roller 134 is driven can be based on a difference in time between when one of the deskewing sensors 136 senses the leading edge 104 of the substrate media 102 and another one of the deskewing sensors 136 senses the leading edge 104 of the substrate media 102. The velocity at which the deskewing roller 134 rotates can be changed by changing the speed at which the drive motor 142 rotates the roller 134 and/or by changing the position of the roller with respect to the substrate media.

As one example, if the substrate media 102 is skewed so that detection of the leading edge 104 by the sensor 144 lags detection of the leading edge 104 by the sensor 146, the drive motor 142 can be controlled by the controller(s) 170 to decrease the velocity at which deskewing roller 134 rotates. As another example, if the substrate media 102 is skewed so that detection of the leading edge 104 by the sensor 146 lags detection of the leading edge 104 by the sensor 144, the drive motor 142 can be controlled by the controller(s) 170 to increase the velocity at which the deskewing roller 134 rotates.

While the present example is illustrative of a technique for deskewing substrate media, those skilled in the art will recognize that other approaches to deskewing substrate media can be implemented. For example, stalled rollers can be used to deskew the substrate media, the rotational velocity of both rollers 132 and 134 can be varied, or the nip pressure of rollers 132 and/or 134 can be varied.

The image transfer region 150 can include a media transport belt 152 (e.g., a media transport unit), at least one lateral media position sensor 154 (hereinafter "lateral sensor 154"), at least one lead edge sensor 156, and print station 158. The substrate media 102 is transferred to the media transport belt 152 of the image transfer region 150 by the deskewing rollers 132 and 134. In some embodiments, the media transport belt 152 can be an electrostatic transport belt or vacuum transport belt.

When the media transport belt 152 is implemented as electrostatic transport belt, electrostatic charge can be used to attract the substrate media to the electrostatic transport belt. The electrostatic charge causes the substrate media to "stick" to the media transport belt to inhibit movement of the substrate media during the printing process. While the substrate media is on the electrostatic transport belt, the substrate media typically does not shift unless a force is applied to the substrate media overcoming the force of attraction resulting from the electrostatic charge and/or the electrostatic charge is removed. Thus, the substrate media typically does not shift while it is disposed on the electrostatic transport belt.

When the media transport belt 152 is a vacuum transport belt, suction can be used to hold the substrate media in place on the vacuum transport belt. The suction causes the substrate media to "stick" to the media transport belt to inhibit movement of the substrate media during the printing process. While the substrate media is on the vacuum transport belt, the substrate media typically does not shift unless a force is applied to the substrate media overcoming the force of attraction resulting from the suction and/or the suction is removed. Thus, the substrate media typically does not shift while it is disposed on the vacuum transport belt.

As the substrate media 102 is passed to the image transfer region 150 from the deskewing region 130, the lateral sensor 154 can detect a lateral position of the substrate media 102. The lateral sensor 154 can be positioned on one side of the media transfer belt 152. For example, in the present example, the lateral sensor 154 is positioned on an inboard side 164 of the media transport belt 152. In some embodiments, the lateral sensor 154 can be positioned on the outboard side 166 of the media transport belt 152.

In some embodiments, the lateral sensor 154 can detect a distance the deskewed substrate media deviates from an expected, intended, and/or desired lateral position and can output a lateral sensor signal to the controller(s) 170. In some embodiments, the lateral sensor 154 can detect the lateral location of the substrate media and can output a lateral sensor signal to the controller(s) 170. The output signal of the lateral sensor 154 can be used by the controller(s) 170 to perform lateral registration of the image with respect to the substrate media 102 by adjusting the placement of ink by the print station 158 and without requiring realignment of the substrate media on the transport belt or warping of the image to be disposed on the substrate media. In this manner, cross process registration can be achieved in response to detection of the lateral position of the substrate media and adjusting the disbursement of ink at the print station to compensate for the lateral position of the substrate media. Those skilled in the art will recognize that other implementations can be used for detecting the lateral position of the substrate media.

As the substrate media 102 continues in the process direction, the edge sensor 156 can detect when the process direction position of the substrate media by detecting, for example, lead edge 104 and/or the trail edge 106 of the substrate media 102 as it passes by the edge sensor 156. Upon detection of the process direction position, the edge sensor 156 can output an edge sensor signal to the controller(s) 170, which can be used by the controller(s) 170 to determine when to initiate disbursement of ink by the print station 158. In some embodiments, the lateral sensor 154 and the edge sensor 156 can be implemented as a single sensor or an integrated sensor. The sensors can be implemented as a point sensor and/or an array sensor. Those skilled in the art will appreciate that the process direction position of the sheet could alternatively be detected using a sensor positioned near the trail edge of the sheet, instead of or in addition to, providing a sensor positioned to detect the lead edge of the sheet.

The print station 158 can include one or more print heads 160. The print heads 160 can operate to dispose ink on the substrate media 102 as the substrate media 102 is transported passed the print station 158 by the media transport belt 152. In some embodiments, the print heads 160 can be formed as page-width-sized print heads so that the lateral width of the substrate media (e.g., the width of the substrate media in the cross-process direction) can receive ink from a print head. In some embodiments, the print heads 160 can be wider than the lateral width of the substrate media and/or the print heads 160 can be shifted in the cross-process direction. The print heads 160 can eject the same and/or different color inks on the substrate media. For example, in some embodiments, each of the print heads 160 can dispose a different color ink on the substrate media such that the printing system can be a multicolor printer.

The timing of the ejection of the ink can be based on the detection of the process direction position of the substrate media by the edge sensor 156. For example, the controller(s) 170 can be configured to instruct the print heads 160 to eject the ink on the substrate media 102 after a predetermined amount of time has passed from the detection of the leading edge 104 and/or the trailing edge 106 by the edge sensor 156. In some embodiments, the predetermined amount of time can be based on the distance between the edge sensor 156 and the print station 158 as well as the speed at which the media transport belt 152 transports the substrate media 102 in the process direction. In another embodiment, an encoder on the drive shaft of the transport belt 152 could be used to infer the distance the media has traveled since the process direction position was measured and the signal from the encoder could be used to trigger the firing of the ink jet print nozzles.

In this manner, process direction registration can be achieved in response to sensing the lead edge and/or the trail edge of the media and adjusting the firing of the print heads 160 to match the substrate media position and timing without having to adjust the substrate media to correct for errors in the location of the substrate media in the process direction and without warping the image to be disposed on the substrate media. For embodiments implemented as cut-sheet ink jet systems, a precise timing or cadence is not required for delivery of substrate media 102 to the print station. The substrate media 102 can arrive with timing errors and can still be imaged accurately in terms of process direction registration.

One or more of the controllers 170 can be implemented to facilitate a registration process 182 in the printing system 100. One or more of the controllers 170 can be in communication with the drive motors 116 and/or 142 to control the rotation of the rollers 112, 132, and 134; the sensors 136, 154, and 156 to receive and process sensor signals; the print heads 160 to control ink deposition; and with the storage 180, which can be implemented as non-transitory computer readable storage medium. The storage 180 can store instructions that when executed by one or more of the controller(s) 170 of the printing system 100 cause the registration system to implement the registration process 182. Some examples of non-transitory computer readable storage mediums can include a floppy drive, hard drive, compact disc, tape drive, Flash drive, optical drive, read only memory (ROM), random access memory (RAM), and the like.

Referring to FIG. 2, the curing unit 210 can be downstream of the print station 158 and can be used to cure the ink that is disposed on the substrate media by the print heads 160. The curing unit can use heat generated, for example, using ultraviolet radiation, infrared radiation, and/or other heat generating techniques. The output unit 220 can be downstream of the curing unit 210 and can receive substrate media having images cured thereon by the curing unit 210. The output unit 220 can output the substrate media.

Figure 3:
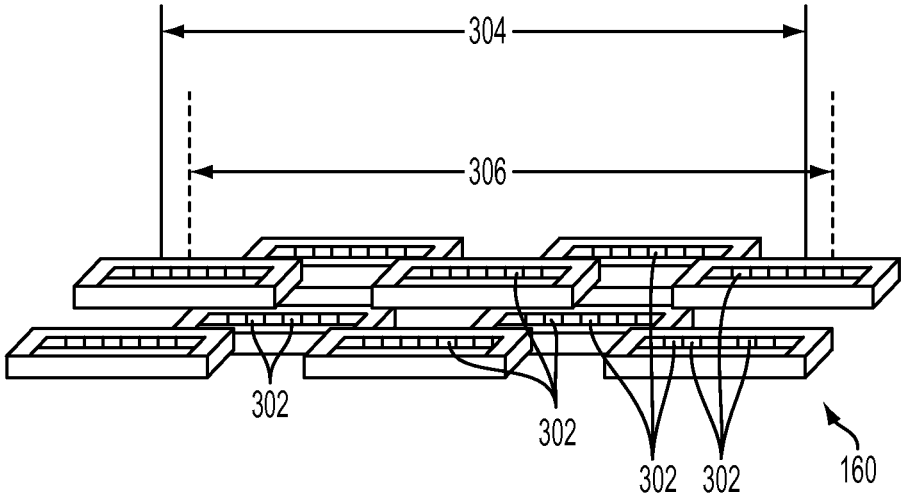
FIG. 3 shows an exemplary print head array for use in a printing system.

Referring to FIG. 3, the print heads 160 can include print nozzles 302 distributed across a bottom of the print heads 160 in one or more arrays. Ink can be selectively ejected from the print nozzles 302 to print an image on the substrate media 102. The print heads 160 include print nozzles arrays of sufficient size and density such that the set of nozzles used to print the image can be shifted by one or more nozzles or pixels to match the measured lateral position of the substrate media. The print heads 160 can be controlled to eject ink from selected print nozzles 302 based on a location on the substrate media. For example, a default set 304 of print nozzles 302 can be selected when no compensation of deviations of the substrate media in the lateral direction is performed and a different set 306 of print nozzles can be selected when compensation of a corresponding deviation of the substrate media in the lateral direction is performed.

For example, in response to the output of the lateral sensor 154, the controller(s) 170 can control the print heads 160 so that the selected print nozzles eject ink to compensate for a detected deviation of the substrate media in the cross process direction. In some embodiments, the print heads 160 can be shifted in the cross-process direction to compensate for the lateral position of the substrate media to compensate for a detected deviation of the substrate media in the cross process direction. Thus, lateral media registration can be accomplished by selecting the appropriate subset of nozzles to use when writing the image and/or shifting the print heads 160 in the cross-process direction. Using this approach an image to be disposed on the substrate media by ejection of the ink is shifted uniformly in the cross-process direction to compensate for the lateral position of the substrate media so that the image to be disposed in the substrate media is not warped.

Figure 4:
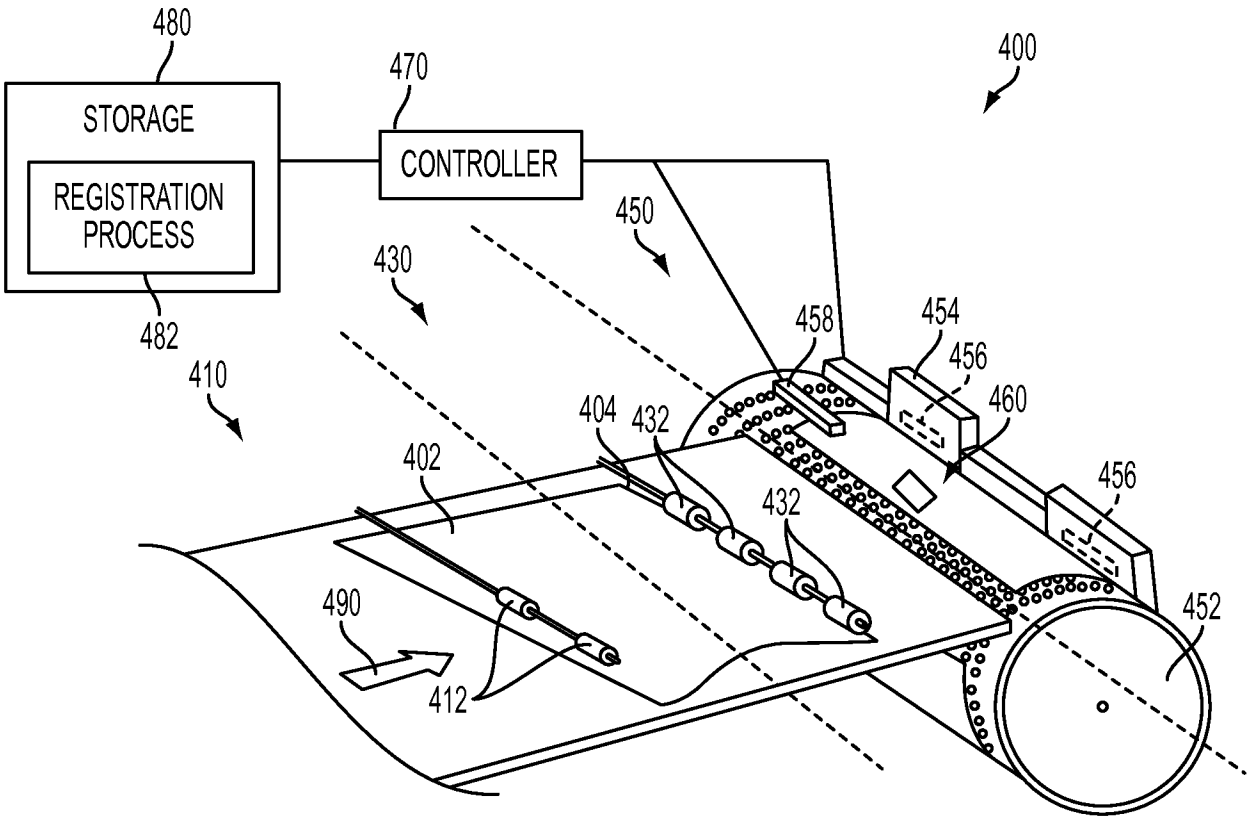
FIG. 4 shows another exemplary printing system in which a substrate media registration system can be implemented.

FIG. 4 shows a printing system 400 in which substrate media registration can be implemented that deskews substrate media, adjust the printing process based on a lateral position of the substrate media, and synchronizes ink disbursement with the arrival of the substrate media. The printing system 400 can include a transport region 410, a deskewing region 430, and an image transfer region 450. The transport region can transport the substrate media 402 in the process direction indicated by arrow 490 towards the deskewing region 430 using transport rollers 412. The deskewing region 430 can receive the substrate media 402 and can deskew the substrate media using stalled deskewing rollers 432, which provide resistance to progression of the substrate media 402 in the process direction to deskew the lead edge 404 of the substrate media. The deskewed substrate media is transferred to a rotating media drum 452 (e.g., a media transport unit) of the image transfer region 450. In some embodiments, the drum 452 can be a media vacuum drum. In some embodiments, the drum 452 can be an electrostatic media drum.

When the drum 452 is implemented as electrostatic media drum, electrostatic charge can be used to attract the substrate media to the drum. The electrostatic charge causes the substrate media to "stick" to the drum to inhibit movement of the substrate media during the printing process. While the substrate media is on the electrostatic drum, the substrate media typically does not shift unless a force is applied to the substrate media overcoming the force of attraction resulting from the electrostatic charge and/or the electrostatic charge is removed.

When the drum 452 is a vacuum media drum, suction can be used to hold the substrate media in place on the drum. The suction causes the substrate media to "stick" to the drum to inhibit movement of the substrate media during the printing process. While the substrate media is on the drum, the substrate media typically does not shift unless a force is applied to the substrate media overcoming the force of attraction resulting from the suction and/or the suction is removed.

One or more print heads 454 can be distributed about the drum 452 to disburse ink onto the substrate media as the substrate media passes the print heads 454. In some embodiments, the substrate media 402 can remain on the drum 452 for multiple rotations so that the substrate media pass the print heads more than once to build up an image on the substrate media. The print heads can include arrays of print nozzles 456. Ink can be selectively ejected from the print nozzles 456 to print an image on the substrate media 402. The print heads 454 include print nozzles arrays of sufficient size and density such that the set of nozzles used to print the image can be shifted by one or more pixels to match the measured lateral position of the substrate media. The print heads 454 can be controlled to eject ink from selected print nozzles 456 based on a lateral position of the substrate media 402 on the drum 452.

The location of the substrate media on the drum can be detected by a lateral sensor 458. In response to the output of the sensor 458, a controller 470 can control the print heads 454 based on a registration process 482 in storage 480 so that selected print nozzles eject ink to compensate for a detected deviation of the substrate media 402 in the cross process direction. In some embodiments, the print heads 454 can be shifted in the cross-process direction to compensate for the lateral position of the substrate media 402 to compensate for a detected deviation of the substrate media 402 in the cross process direction. Thus, lateral media registration can be accomplished by selecting the appropriate subset of print nozzles to use when writing the image and/or shifting the print heads 454 in the cross-process direction. Using this approach an image to be disposed on the substrate media by ejection of the ink is shifted uniformly in the cross-process direction to compensate for the lateral position of the substrate media so that the image to be disposed in the substrate media is not warped.

The lateral sensor 458 can also operate as a process direction position sensor or a separate edge sensor 460 can be used to sense the process direction position (e.g., the lead edge and/or trail edge) of the substrate media. The timing of the ejection of the ink can be based on the detection of the lead edge of the substrate media by the sensors 458 or 460. For example, the controller(s) 470 can be configured to instruct the print heads 454 to eject the ink on the substrate media 402 after a predetermined amount of time has passed from the detection of the leading edge 404 by the sensor 458 or 460 based on a registration process stored in storage 480. In some embodiments, the predetermined amount of time can be based on the distance between the sensor used to detect the lead edge and the print heads 454 as well as the speed at which the drum 452 rotates. In some embodiments, an encoder on the drum could be used to measure the distance that the drum has rotated since the lead edge of the media was detected and the signal from the encoder could be used to trigger the ejection of ink from the print nozzles. In this manner, process direction registration can be achieved in response to sensing the lead edge of the media and adjusting the firing of the print heads 454 to match the substrate media position and timing without having to adjust the substrate media to correct for errors in the location of the substrate media in the process direction and without warping the image to be disposed on the substrate media.

Figure 5:
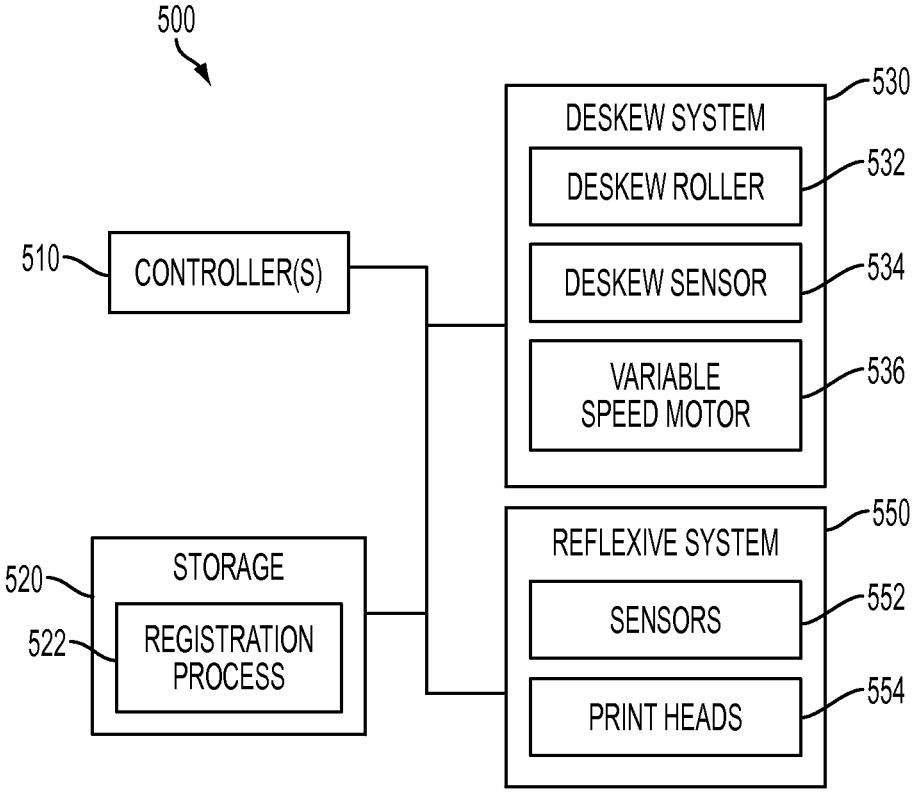
FIG. 5 is an exemplary substrate media registration system.

FIG. 5 depicts a block diagram of an exemplary registration system 500 for a printing system, such as printing systems 100 and/or 400. The registration system 500 can include one or more of the controllers 510, storage 520 storing a regstration process 522, such as registration process 182 and/or 482, deskewing system 530, and reflexive system 550. The components of the registration system 500 can be distributed in one or more of the regions of the printing system. The registration system 500 can be configured to deskew substrate media, adjust ink disbursement in the cross-process or lateral direction based on a lateral position of the substrate media, and synchronize ink disbursement with the arrival of the substrate media. Embodiments of the registration system 500 can register the substrate media with respect to skew, lateral position errors, and process direction errors without shifting the substrate media to correct for the cross-process direction and process direction errors and without warping the image to be disposed on the substrate media.

In the present embodiment, the deskewing system 530 can include deskew rollers, such as deskew rollers 532, such as rollers 132 and 134 or stalled rollers 432, and the reflexive system 550 can include the sensors 552, such as sensors 154, 156, 458, and/or 460, and the print heads 554, such as print heads 160 or print head 454. In some embodiments, the deskewing system 530 can also include deskew sensors 532, such as deskew sensors 136, and a variable speed drive motor 536, such as drive motor 142. Controllers 510, storage 520, and components of the deskewing system 530 and reflexive system 550 can be implemented as described herein.

Figure 6:
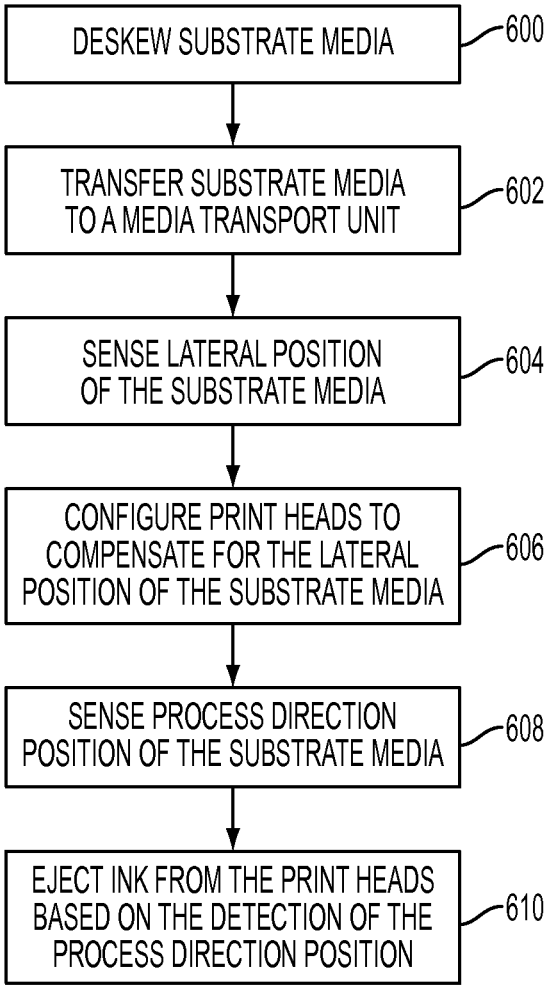
FIG. 6 is a flowchart of an exemplary registration process that can be implemented by the substrate media registration system.

FIG. 6 is a flowchart illustrating an exemplary embodiment of the registration process implemented by the registration system 500 of a printing system, such as printing system 100 and/or 400. The registration process is accomplished without warping the image. Substrate media being transported through the printing system is deskewed by the deskewing system (600). The deskewing system can deskew the substrate media in response to detecting that the substrate media is skewed. After the substrate media has been deskewed, the substrate media is transferred to a media transport unit on which the position of the substrate media is fixed (602). The lateral position of the deskewed substrate media is sensed using the reflexive system (604) and the subset of nozzles within the print heads of the printing system are selected to compensate for the lateral position of the substrate media by the controller (606). Using this approach an image to be disposed on the substrate media by ejection of the ink can be shifted uniformly in the cross-process direction to compensate for the lateral position of the substrate media so that the image to be disposed in the substrate media is not warped. The process direction position (e.g., lead edge and/or trail edge) of the substrate media is sensed using the reflexive system (608) and ink is ejected from the print heads based on the detection of the process direction position (610).

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A direct marking printing system configured for substrate media registration without warping an image comprising:

a print head with a plurality of print nozzles;

a media transport unit to transport substrate media passed the print head;

a deskewing system having at least one roller to deskew the substrate media;

a reflexive system having one or more sensors to detect a lateral position of the substrate media on the media transport unit and at least one of the lead and trail edge of the substrate media while the substrate media is moving in the process direction under action by the media transport unit; and a controller operatively coupled to the print head and the reflexive system, the controller selecting a subset of print nozzles from which ink is to be ejected based on the lateral position of the substrate media on the media transport unit and determining when the ink is to be ejected from the subset of print nozzles in response to detection of the process direction position of at least one of the lead edge and trail edge of the substrate media.

2. The system of claim 1, wherein the deskewing system comprises deskewing sensors and deskew rollers, the deskewing sensors detecting whether substrate media is skewed, a first one of the dekewing rollers being driven at a first velocity and a second one of the rollers being driven at a second velocity that is adjusted relative to the first velocity of the first deskewing roller in response to the deskewing sensors detecting that the substrate media is skewed so that the deskewing system deskews the substrate media prior to receipt of the substrate media by the media transport unit.

3. The system of claim 2, wherein the controller is operatively coupled to the deskewing system to control the velocity of the first deskewing roller to be constant, and to control the speed at which the second motor rotates the second one of the deskewing rollers to deskew the media.

4. The system of claim 1, wherein the controller selects the subset of print nozzles from which ink is ejected to align an image to be formed by the print head with the lateral position of the substrate media.

5. The system of claim 1, wherein process direction registration is controlled by timing the ejection of ink from the print head based on detection at least one of the lead edge and trail edge of the substrate media.

6. The system of claim 1, wherein the one or more sensors function as a lateral sensor by detecting an edge of said media.

7. A substrate media registration system in a printing system comprising:

a deskewing system configured to deskew substrate media;

a reflexive system configured to detect the lateral position of the substrate media and at least one of a lead edge and trail edge of the substrate media while the substrate media is moving in the process direction; and a controller operatively coupled to the reflexive system and configured to control an ejection of ink from a print head of the reflexive system in response to detecting the lateral position of the substrate and the process direction position of at least one of the lead edge and trail edge of the substrate media.

8. The system of claim 7, wherein the deskewing system comprises deskewing sensors and deskew rollers, the deskewing sensors detecting whether substrate media is skewed, a first one of the dekewing rollers being driven at a different velocity than a second one of the rollers in response to the deskewing sensors detecting that the substrate media is skewed so that the deskewing system deskews the substrate media prior to receipt of the substrate media by the media transport belt.

9. The system of claim 8, wherein the deskewing system includes at least one drive motor and the controller is operatively coupled to the deskewing system to control the velocity of the at least one drive motor rotating at least one of the deskewing rollers.

10. The system of claim 7, wherein the deskewing system aligns the substrate media so that the lead edge of the substrate media is substantially parallel to a cross-process direction of the printing system or the side edge is substantially parallel to a process direction of the printing system, and the controller adjusts the lateral position of an image to be disposed on the substrate media based on a lateral position of the substrate media so that the image to be disposed on the substrate media is properly aligned with the substrate media.

11. The system of claim 7, wherein the deskewing system comprises a plurality of deskew rollers, a position of the at least one deskew roller being adjustable with respect to the substrate media to change a velocity of the at least one deskew roller with respect to at least another one of the deskew rollers.

12. The system of claim 7, wherein the media transport unit comprises at least one of a media transport belt and a media drum.

13. The system of claim 12, wherein the media transport unit is a media transport belt and the substrate media is transported passed the print head once to form an image on a surface of the substrate media.

14. The system of claim 12, wherein the media transport unit is the media drum and the substrate media is transported passed the print head multiple times to form an image on a surface of the substrate media.

15. The system of claim 7, wherein cross-process direction registration is controlled based on the lateral position of the substrate media and the controller selects the subset of print nozzles from which ink is ejected to align an image to be formed by the print head with the lateral position of the substrate media.

16. The system of claim 7, wherein process direction registration is controlled by timing the ejection of ink from the print head based on detection of at least one of the lead edge and trail edge of the substrate media.

17. The system of claim 7, wherein the reflexive system comprises a lateral sensor to detect the lateral position of the substrate media and an edge sensor to detect the process direction position of at least one of the lead edge and the trail edge of the substrate media.

18. A method of registering substrate media in a printing system comprising:

deskewing the substrate media using at least one deskewing roller to perform at least one of aligning a lead edge of the substrate media to be substantially parallel to a cross-process direction and aligning the side edge of the media to be substantially parallel to a process direction of the printing system;

transferring the substrate media to a media transport unit, a position of the substrate media being fixed with respect to the media transport unit;

detecting a lateral position of the substrate media on the media transport unit when the substrate media is moving in the process direction past a lateral position sensor;

detecting the process direction position of the substrate media on the media transport unit when the substrate media is moving in the process direction past an edge sensor;

configuring a print head to compensate for the lateral position of the substrate media on the media transport unit; and ejecting ink from the print head in response to detecting process direction position of the substrate media.

19. The method of claim 18, wherein an image to be disposed on the substrate media by ejection of the ink is shifted uniformly in the cross-process direction to compensate for the lateral position of the substrate media so that the image to be disposed in the substrate media is not warped.

20. The method of claim 18, wherein configuring the print head comprises:

selecting a subset of print nozzles of the print head from which ink is to be ejected to align ejection of ink with the lateral position of the substrate media.

* * * * *